US010851969B2

(12) United States Patent
Wang

(10) Patent No.: US 10,851,969 B2
(45) Date of Patent: Dec. 1, 2020

(54) REFLECTOR AND LIGHTING APPARATUS

(71) Applicant: OPPLE LIGHTING CO., LTD., Shanghai (CN)

(72) Inventor: Quanbiao Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 4 days.

(21) Appl. No.: 16/389,901

(22) Filed: Apr. 19, 2019

(65) Prior Publication Data

US 2019/0323680 A1 Oct. 24, 2019

(30) Foreign Application Priority Data

Apr. 24, 2018 (CN) ..... 2018 1 0374460
Apr. 24, 2018 (CN) ..... 2018 2 0593418 U

(51) Int. Cl.
*F21V 7/04* (2006.01)
*F21V 29/70* (2015.01)
*F21Y 115/10* (2016.01)

(52) U.S. Cl.
CPC ..... *F21V 7/04* (2013.01); *F21V 29/70* (2015.01); *F21Y 2115/10* (2016.08)

(58) Field of Classification Search
CPC ..... F21V 7/04; F21V 29/70; F21Y 2115/10
See application file for complete search history.

(56) References Cited

U.S. PATENT DOCUMENTS

2019/0323680 A1* 10/2019 Wang ..... F21V 29/70

* cited by examiner

*Primary Examiner* — Joseph L Williams
(74) *Attorney, Agent, or Firm* — Arch & Lake LLP

(57) ABSTRACT

The present disclosure provides a reflector and a lighting apparatus, which belongs to a field of lighting technology. The reflector is provided with a mounting table and a reflecting chamber, the mounting table is connected with a periphery of a light incident port of the reflecting chamber and extends outwards along a radial direction of the reflecting chamber, and the mounting table is provided with a lens connecting portion and a light source connecting portion for implementing positioning or connection of a light source module and a lens, so that in the assembling process, the light source module and the lens can be mounted on a housing together with the reflector without being mounted in an accommodating chamber of the housing one by one.

20 Claims, 6 Drawing Sheets

REFLECTOR AND LIGHTING APPARATUS

CROSS-REFERENCE TO RELATED APPLICATIONS

This application is based upon and claims the priority of Chinese Patent Application No. 201810374460.9 filed on Apr. 24, 2018, and Chinese Patent Application No. 201820593418.1 filed on Apr. 24, 2018, the entire content of all of which is hereby incorporated by reference herein for all purposes.

TECHNICAL FIELD

The present invention relates to the technical field of lighting, and particularly relate to a reflector and a lighting apparatus.

BACKGROUND

An Light-Emitting Diode (LED) lighting apparatus includes an LED light source, a lens, a reflector, a housing and the like. The housing commonly has a light emergent port, a bottom wall opposite to the light emergent port and an accommodating chamber connecting the light emergent port and the bottom wall; and generally, components, such as the LED light source, the lens, the reflector and the like, are all mounted inside the accommodating chamber of the housing from the light emergent port of the housing one by one and need to be directly mounted on the housing in a bracket or buckle connecting mode.

SUMMARY

The present disclosure discloses a reflector and a lighting apparatus.

The present disclosure provides a reflector. The reflector may include a mounting table and a reflecting chamber, where the reflecting chamber has an axis and a light incident port and a light emergent port which are opposite to each other and sequentially distributed along a direction of the axis, and the mounting table is connected with a periphery of the light incident port and extends outwards along a radial direction of the reflecting chamber; and a lens connecting portion and a light source connecting portion are disposed on the mounting table.

The present disclosure also provides a lighting apparatus. The lighting apparatus may include a lens, a light source module and the reflector. The reflector may include a mounting table and a reflecting chamber, where the reflecting chamber has an axis and a light incident port and a light emergent port which are opposite to each other and sequentially distributed along a direction of the axis, and the mounting table is connected with a periphery of the light incident port and extends outwards along a radial direction of the reflecting chamber; and a lens connecting portion and a light source connecting portion are disposed on the mounting table.

The lens included in the lighting apparatus may be positioned between the light incident port and the light source module along the direction of the axis, the lens may include a light distributing portion and a mounting portion connected with the light distributing portion, the light distributing portion may cover the light incident port and the mounting portion may be connected to the lens connecting portion; and the light source module may include a substrate and a light-emitting unit mounted on the substrate, the substrate may be connected to the light source connecting portion, and the light-emitting unit may face the light distributing portion.

It is to be understood that both the foregoing general description and the following detailed description are exemplary and explanatory only and are not restrictive of the present disclosure.

BRIEF DESCRIPTION OF THE DRAWINGS

The drawings illustrated herein are used for providing further understanding on the present disclosure and constitute one part of the present disclosure, and schematic examples of the present disclosure and illustration thereof are used for explaining the present disclosure, but do not constitute improper limitation to the present disclosure. In the drawings.

DETAILED DESCRIPTION

Figure 1:
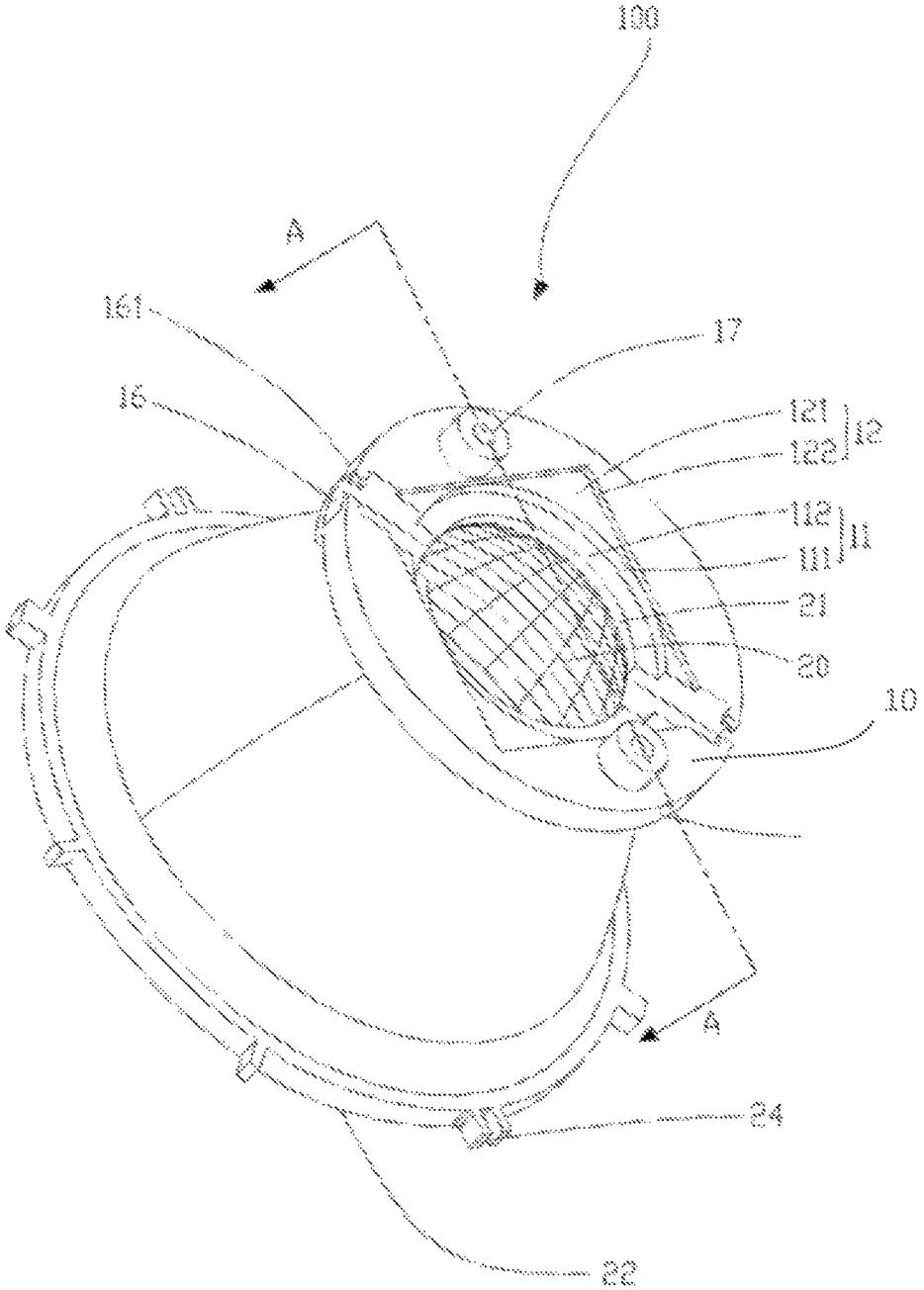
FIG. 1 is a structural diagram of a reflector in an example of the present disclosure.

In order to make purposes, technical solutions and advantages of the present invention more apparent, the technical solutions of the present invention will be described in a clearly and fully understandable way in connection with the examples and the drawings related to the examples of the invention. It is obvious that the described examples are just a part but not all of the examples of the invention. Based on the described examples herein, those skilled in the art can obtain other example(s), without any inventive work, which should be within the scope of the invention.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals shown in FIG. 1 to FIG. 6 are:

100—reflector; 10—mounting table; 11—lens connecting portion; 111—lens supporting surface; 112—lens positioning surface; 12—light source connecting portion; 121—light source supporting surface; 122—light source positioning surface; 13—first surface; 14—second surface; 15—outer sidewall; 16—first wire groove; 161—chunk; 17—first threaded hole; 18—second surface;

20—reflecting chamber; 21—light incident port; 22—light emergent port; 23—reflecting surface; 231—specular reflecting region; 232—diffuse reflecting region; 24—fool-proof portion;

30—lens; 31—light distributing portion; 32—mounting portion; 321—first mounting surface; 322—second mounting surface; 323—second wire groove; 324—circumferential positioning part; 325—first outer ring surface;

40—light source module; 41—substrate; 411—first base surface; 412—second base surface; 413—second outer ring surface; 42—light-emitting unit;

50—housing; 51—housing light emergent port; 52—bottom wall; 521—second threaded hole; 53—accommodating chamber; 54—sidewall; 541—fool-proof structure; 55—heat dissipating portion;

60—fastener; and

200—lighting apparatus.

With respects to the mounting mode of an LED light apparatus, most of components need to be mounted inside the accommodating chamber of the housing one by one, but the accommodating chamber is limited in space, and thus, an operation space for mounting or disassembling those components is limited by the accommodating chamber of the housing, resulting in that the process difficulty is high in the repairing or maintaining process, and connection between part of the components and the housing needs to adopt clamping connection, which may result in damage to the components in the repairing or maintaining process.

As illustrated in FIG. 1, a reflector 100 provided by an example of the present disclosure includes a mounting table 10 and a reflecting chamber 20, the reflecting chamber 20 has an axis, and a light incident port 21 and a light emergent port 22 which are opposite to each other, and the light incident port 21 and the light emergent port 22 are sequentially arranged along the axis. The mounting table 10 is connected with a periphery of the light incident port 21 and extends outwards along a radial direction of the reflecting chamber 20, i.e., the mounting table 10 is disposed outside the reflecting chamber 20, so as to avoid interference to light emerging from the light emergent port 22 after entering the reflecting chamber 20 from the light incident port 21 and being reflected. The reflecting chamber 20 may be of a revolving body structure. A lens connecting portion 11 and a light source connecting portion 12 are disposed on the mounting table 10 and are used for implementing positioning or connection of a light source module and a lens, so that in the assembling process, the light source module and the lens can be mounted on a housing together with the reflector 100 without being mounted in an accommodating chamber of the housing one by one; moreover, the mounting table 10 is not positioned inside the reflecting chamber 20, and thus, mounting of the light source module and the lens can be implemented outside the reflecting chamber 20 so as to facilitate assembling.

Figure 2:
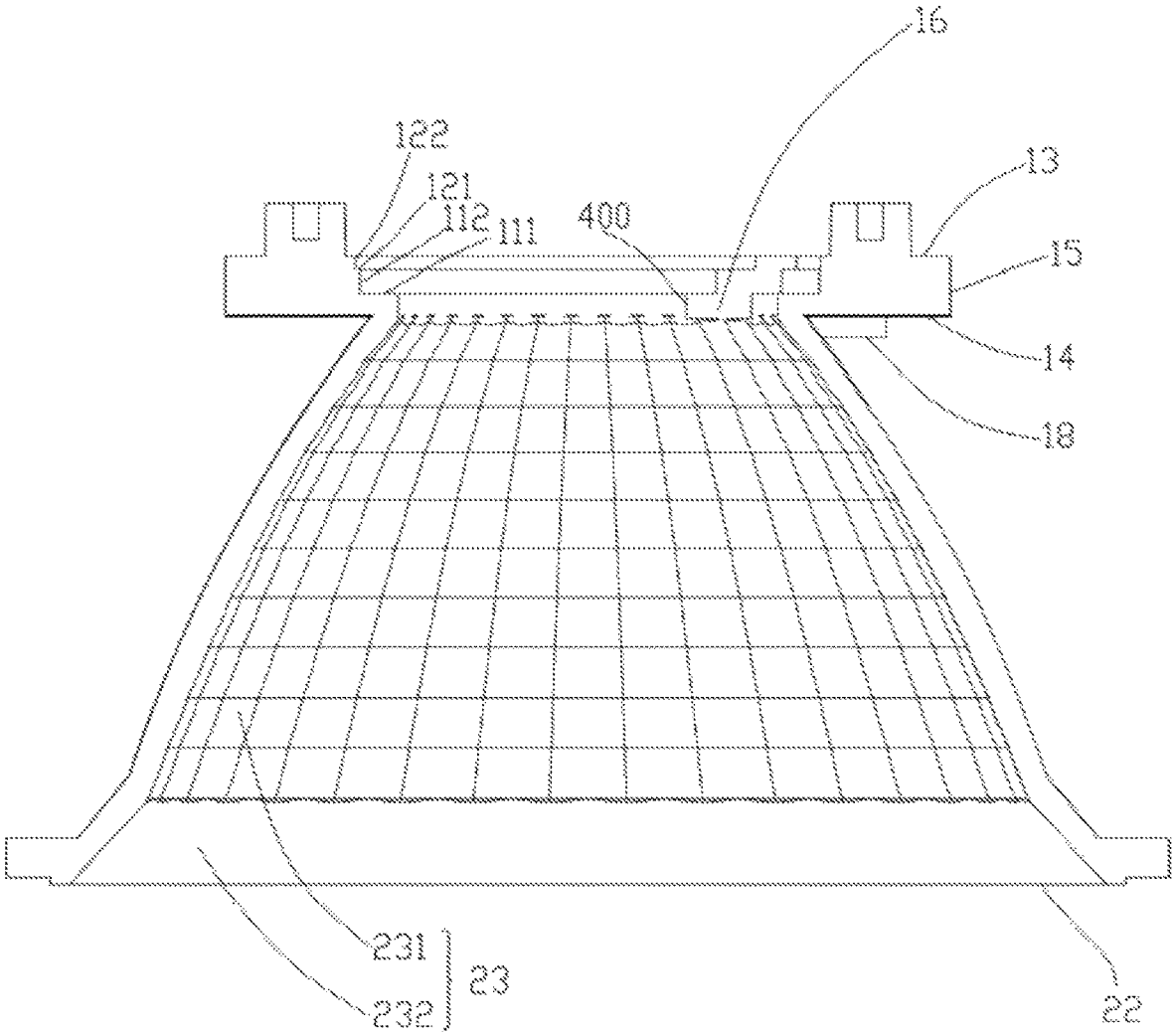
FIG. 2 is an A-A cross-sectional diagram of the reflector in FIG. 1.

FIG. 2 is an A-A cross-sectional diagram of the reflector in FIG. 1. The mounting table 10 is of a plate shape and has a first surface 13 and a second surface 14 which face away from each other and extend along a radial plane of the reflecting chamber 20; and with respect to the second surface 14, the first surface 13 is away from the light emergent port 22. The lens connecting portion 11 and the light source connecting portion 12 are disposed on the first surface 13. In a lighting apparatus, a light distributing portion of the lens needs to cover the light incident port 21, a light-emitting unit of the light source module needs to face the light distributing portion, and when the lens connecting portion 11 and the light source connecting portion 12 are disposed on the first surface 13, a distance between a connecting portion and the light distributing portion of the lens is relatively short and the size of a base plate can also be miniaturized, i.e., the lens and the light source module may be set to have small volumes. In part of examples, the lens connecting portion 11 and the light source connecting portion 12 may be disposed outside the first surface 13, e.g., on the second surface 14 or at other positions of the mounting table 10.

The lens connecting portion 11 surrounds the light incident port 21 along a circumferential direction of the reflector 100, i.e., the lens connecting portion 11 is of a ring shape, and the lens connecting portion 11 disposed on the periphery of the light incident port 21 enables the lens to be stably mounted on the reflector 100. The light source connecting portion 12 circumferentially surrounds the lens connecting portion 11, i.e., the light source connecting portion 12 is of a ring shape, so that the light source module can be stably mounted on the reflector 100. The ring shapes of the lens connecting portion 11 and the light source connecting portion 12 may be a shape of a closed ring or an open ring, and for example, a ring shape formed by the surrounding of a plurality of arc sections at intervals; and the ring shape may also be a shape of a circular ring, or an oval ring, polygon and the like. Moreover, the lens connecting portion 11 and the light incident port 21 may be connected or kept at an interval on the radial plane, and similarly, the light source connecting portion 12 and the light incident port 21 may be connected or kept at an interval on the radial plane.

The lens connecting portion 11 has a lens supporting surface 111 which is of a ring shape and extends along the radial plane, and the lens supporting surface 111 is used for supporting the lens or a mounting portion of the lens so as to implement positioning or assembling of the lens and the reflector 100 in the axial direction. The light source connecting portion 12 has a light source supporting surface 121 extending along the radial plane, and the light source supporting surface 121 may be of a random ring shape and particularly, may be a closed ring shape or an open ring shape. The open ring shape means a ring shape which may be formed by connection and surrounding of a plurality of sections of portions separated from each other.

The light source supporting surface 121 is used for supporting the light source module or a substrate of the light source module so as to implement positioning or assembling of the light source module and the reflector 100 in the axial direction. The lens supporting surface 111 may be connected or kept at an interval with the light incident port 21, and similarly, the light source supporting surface 121 may be connected or kept at an interval with the lens supporting surface 111. In order to enable the lens to be positioned between the light incident port 21 and the light source module, the mounting portion of the lens and the substrate of the light source module may be of a flat plate shape, and with respect to the lens supporting surface 111, the light source supporting surface 121 should be away from the light emergent port 22.

The lens connecting portion 11 further includes a lens positioning surface 112, the lens positioning surface 112 extends from the lens supporting surface 111 towards a direction facing away from the second surface 14, and the lens positioning surface 112 may be in parallel to the axis of the reflector 100 or an included angle may be formed between the lens positioning surface 112 and the axis of the reflector 100. The lens positioning surface 112 is used to position the lens on the radial plane so as to facilitate assembling. The light source connecting portion 12 further has a light source positioning surface 122, the light source positioning surface 122 extends from the light source supporting surface 121 towards the direction facing away from the second surface 14, and the light source positioning surface 122 may be in parallel to the axis of the reflector 100 or an included angle may be formed between the light source positioning surface 122 and the axis of the reflector 100. The light source positioning surface 122 is used to position the light source module on the radial plane so as to facilitate assembling. Both the lens positioning surface 112 and the light source positioning surface 122 may be disposed in a ring shape.

The lens supporting surface 111 is connected with the light incident port 21, the lens positioning surface 112 is connected with the lens supporting surface 111 and the light source supporting surface 121, the light source positioning surface 122 is connected with the light source supporting surface 121 and the first surface 13, so that the light source connecting portion 12 and the lens connecting portion 11 are disposed in a highly centralized mode on the first surface 13, and the size of the radial plane of the first surface 13 can be minimized, thereby enabling the volume of the mounting table 10 to be minimized.

The lens supporting surface 111, the light source supporting surface 121 and the light incident port 21 may be coaxially disposed, and the lens positioning surface 112 and the light source positioning surface 122 may also be disposed coaxially with the light incident port 21.

The lens connecting portion 11 and the light source connecting portion 12 may also be of a non-ring shape and for example, a random shape such as an asymmetrical shape or a bias shape on one side on the first surface 13, as long as the lens and the light source module can be connected. Correspondingly, the lens supporting surface 111 and the light source supporting surface 121 may also be of a non-ring shape and for example, a random shape such as an asymmetrical shape or a bias shape.

The mounting table 10 has an outer sidewall 15 connecting the first surface 13 and the second surface 14 and away from the light incident port 21, a first wire groove 16 is disposed on the first surface 13, and the first wire groove 16 is in through connection with the light incident port 21 and the outer sidewall 15 and naturally, also runs through the light source connecting portion 12 and the lens connecting portion 11, so that a wire (not shown) on the light source module can extend out of the outer sidewall 15.

Specifically, the first wire groove 16 has a groove bottom connected with the light incident port 21 and the outer sidewall 15 and a groove wall connected with the groove bottom and the first surface 13, a chuck 161 is disposed on the groove wall, a gap is formed between the chuck 161 and the groove bottom, the gap may accommodate the wire, and the chuck 161 can reduce the probability that the wire is separated out of the first wire groove 16.

The mounting table 10 may include a third surface 18 which faces to the same direction as the second surface 14, and with respect to the second surface 14, the third surface 18 is away from the first surface 13. A projection of the first wire groove 16 on the radial plane falls within a projection of the third surface 18 on the radial plane, and then the groove bottom of the first wire groove 16 may be aligned with the second surface 14 on the radial plane.

The reflecting chamber 20 has a reflecting surface 23 for reflecting light; the reflecting surface 23 may include a specular reflecting region 231 and a diffuse reflecting region 232; with respect to the diffuse reflecting region 232, the specular reflecting region 231 is close to the light incident port 21; and in the direction close to the light incident port 21, light is firstly reflected in the specular reflecting region to change the direction, and then is diffused in the diffuse reflecting region, so that a light spot emerging from the light emergent port 22 can be relatively uniform. A ring-shaped boundary is formed between the diffuse reflecting region 232 and the specular reflecting region 231, and an axis of the ring-shaped boundary and the axis of the reflector 100 are in the same direction. With respect to the light incident port 21, the boundary may be closer to the light emergent port 22, so that an area of the specular reflecting region 231 is greater than that of the diffuse reflecting region 232, thereby having low light loss.

The surface roughness of the specular reflecting region 231 is smaller than that of the diffuse reflecting region 232, the surface of the specular reflecting region 231 may be an aluminized specular scale, and the surface of the diffuse reflecting region 232 may be subjected to wiredrawing processing.

The mounting table 10 is provided with a first threaded hole 17 on the periphery of the light source connecting portion 12 so as to mount and connect the reflector 100. An opening of the first threaded hole 17 faces away from the second surface 14.

Figure 3:
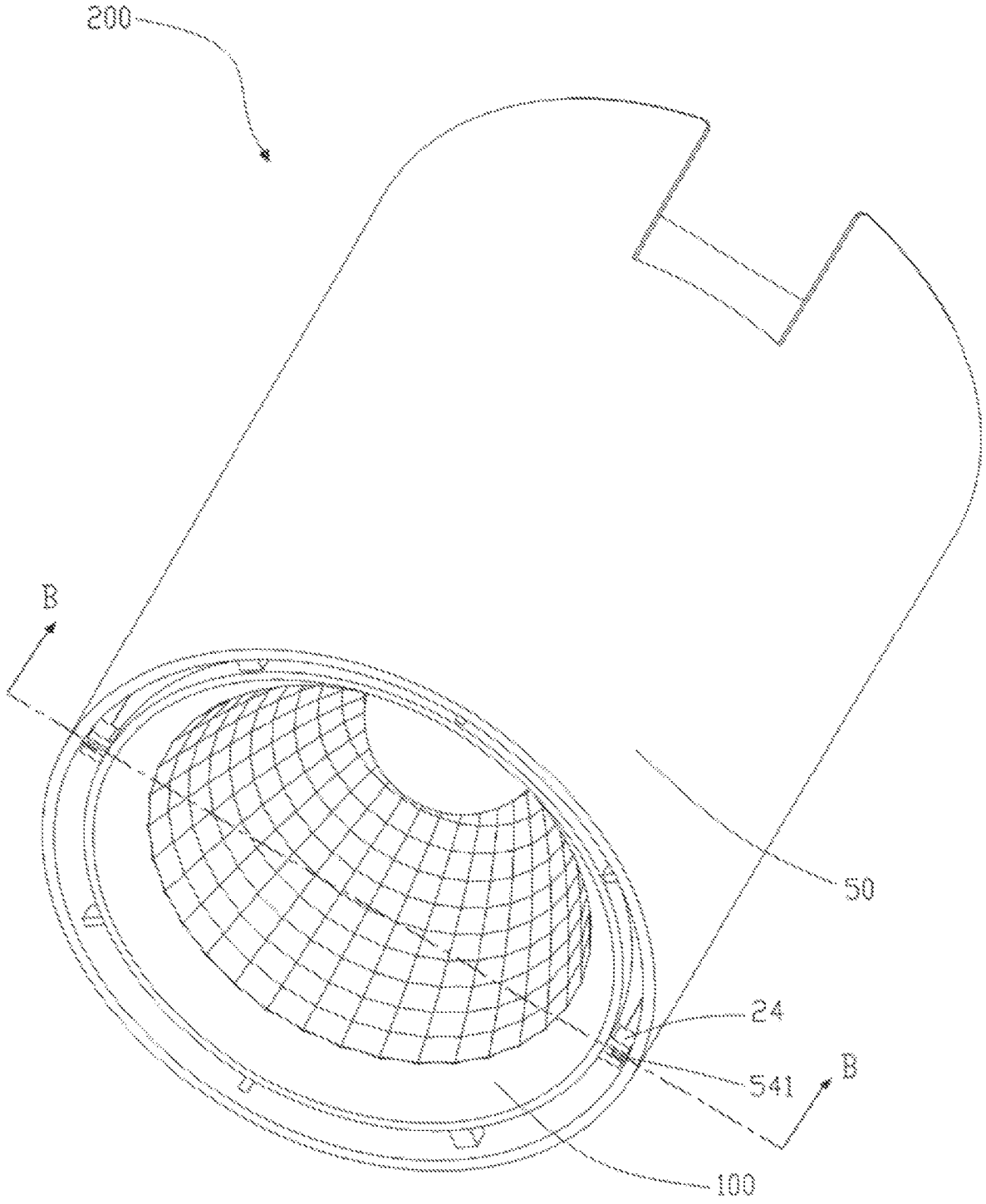
FIG. 3 is a structural diagram of a lighting apparatus in an example of the present disclosure.
Figure 4:
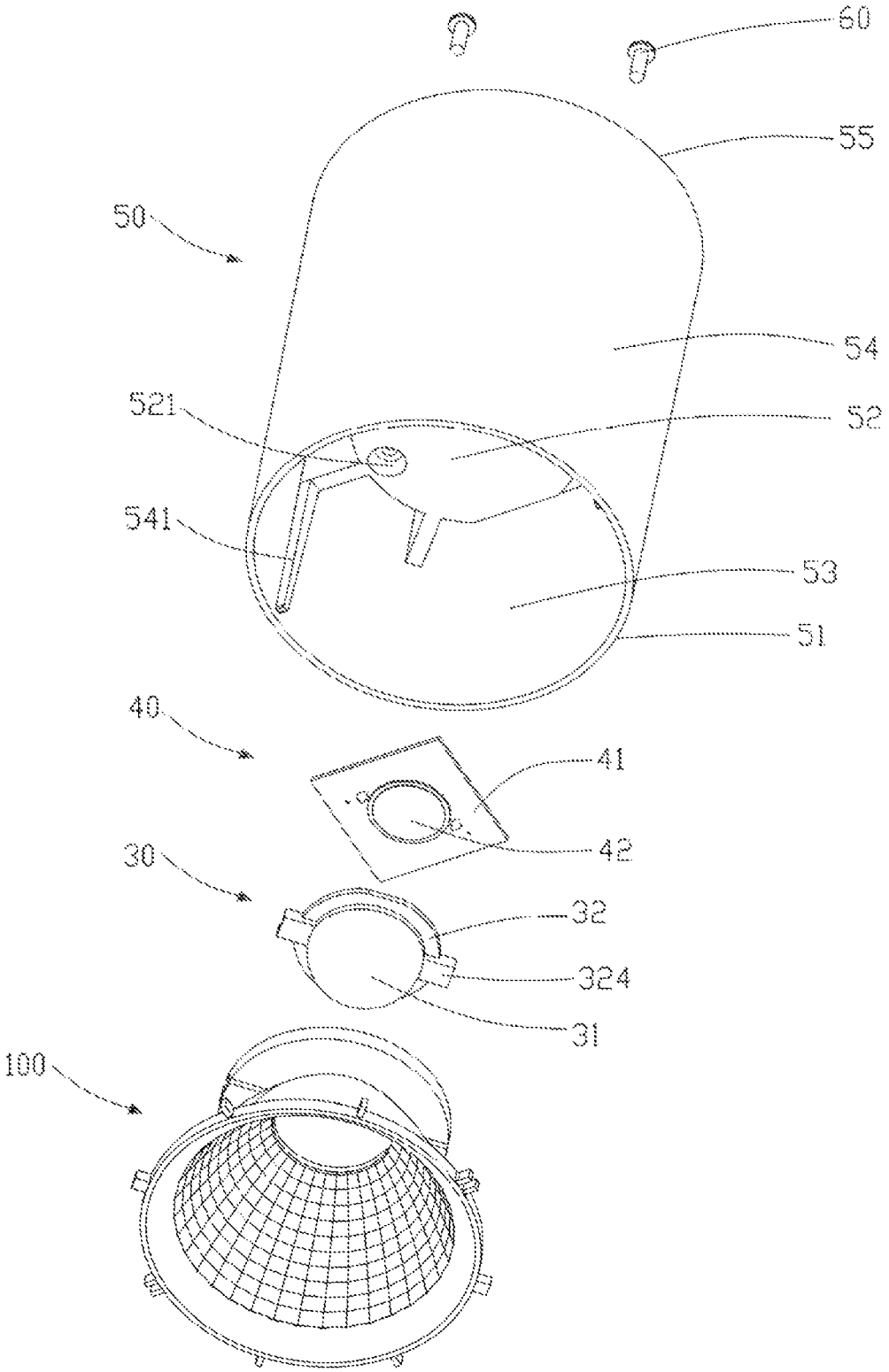
FIG. 4 is an exploded view of the lighting apparatus in FIG. 3.

FIG. 3 is a structural diagram of a lighting apparatus in an example of the present disclosure. As another example of the present disclosure, a lighting apparatus 200 is provided. The lighting apparatus 200 includes a lens 30, a light source module 40 and the above-mentioned reflector 100. FIG. 4 is an exploded view of the lighting apparatus in FIG. 3.

Along the direction of the axis of the reflecting chamber 20, the lens 30 is disposed between the light incident port 21 and the light source module 40. The lens 30 is provided with a light distributing portion 31 and a mounting portion 32 which are connected mutually, the light distributing portion 31 covers the light incident port 21 and the mounting portion 32 is connected to the lens connecting portion 11. The light source module 40 includes a substrate 41 and a light-emitting unit 42 mounted on the substrate 41, the substrate 41 is connected to the light source connecting portion 12, and the light-emitting unit 42 faces the light distributing portion 31. Light emitted by the light-emitting unit 42 is subjected to reflection control in the reflecting chamber 20 after being distributed by the light distributing portion 31, and then emerges from the light emergent port 22.

The mounting portion 32 of the lens 30 surrounds the light distributing portion 31 along the axis of the reflecting chamber 20, i.e., the mounting portion 32 is of a ring shape, and the light distributing portion 31 is positioned at a center of the ring shape; and the light-emitting unit 42 is mounted at a middle portion of the substrate 41, so that the substrate 41 can be small in size and a projection of the substrate 41 on the radial plane can completely cover a projection of the mounting portion 32 on the radial plane.

The light-emitting unit 42 may be an LED light source and specifically, for example, a Chip on Board (COB) light source.

The light distributing portion 31 has a protrusion, and the protrusion extends into the reflecting chamber 20 from the light incident port 21. The mounting portion 32 cannot pass through the light incident port 21, but is positioned outside the reflecting chamber 20.

The mounting portion 32 has a first mounting surface 321 and a second mounting surface 322 which face away from each other and extend along the radial plane, and the first mounting surface 321 is attached to the lens supporting surface 111 so as to position or assemble the lens on the mounting table 10 in the axial direction.

The substrate 41 has a first base surface 411 and a second base surface 412 which face away from each other and extend along the radial plane, the light-emitting unit 42 is mounted at a middle portion on the first base surface 411, and a periphery of the first base surface 411 is attached to the light source supporting surface 121 along the circumferential direction so as to position or assemble the light source module 40 on the mounting table 10 in the axial direction.

The mounting portion 32 further includes a first outer ring surface 325 connecting the first mounting surface 321 and the second mounting surface 322 and away from the light distributing portion 31, and when the first mounting surface 321 is attached to the lens supporting surface 111, the lens positioning surface 112 surrounds the first outer ring surface 325 along the circumferential direction so as to position or assemble the lens on the mounting table 10 on the radial plane. The substrate 41 further includes a second outer ring surface 413 connecting the first base surface 411 and the second base surface 412 and away from the light-emitting unit 42, and when the first base surface 411 is attached to the light source supporting surface 121, the light source positioning surface 122 surrounds the second outer ring surface 413 along the circumferential direction so as to position or assemble the light source module 40 on the mounting table 10 on the radial plane.

Thus, it can be seen that by combining the lens supporting surface 111 and the lens positioning surface 112, the mounting portion 32 implements positioning and assembling in the axial direction and on the radial plane. By combining the light source supporting surface 121 and the light source positioning surface 122, the substrate 41 also implements positioning and assembling in the axial direction and on the radial plane.

The second mounting surface 322 is adjacent to and aligned with the light source supporting surface 121 on the radial plane, and the first base surface 411 is simultaneously attached to the light source supporting surface 121 and the second mounting surface 322, i.e., the first base surface 411 implements limitation to the mounting portion 32 when being attached to the light source supporting surface 121, so that the mounting portion 32 may be clamped between the first base substrate 411 and the light incident port 21. The second base surface 412 may be adjacent to and aligned with the first surface 13 on the radial plane.

A second wire groove 323 in through connection with the light distributing portion 31 and the first outer ring surface 325 is disposed on the second mounting surface 322, and the second wire groove 323 is in through connection with the first wire groove 16. When the first base surface 411 is attached to the light source supporting surface 121 and the second mounting surface 322, the wire connected to the first base surface 411 may extend out of the outer wall after sequentially passing through the second wire groove 323, the first wire groove 16. Specifically, the first wire groove 16 and the second wire groove 323 may be in through connection along a radial direction. A wire of the light source module may be welded on the first base surface 411, and a welding spot on the first base surface 411 is also positioned in the second wire groove 323.

A circumferential positioning part 324 may also be arranged on the first mounting surface 321, and the circumferential positioning part 324 is positioned in the same radial direction with the first wire groove 16 and the second wire groove 323 and may extend into the first wire groove 16 so as to implement mistake proofing during circumferential positioning of the mounting portion 32 and enable the first wire groove 16 and the second wire groove 323 to rapidly form radial through connection.

Where, the first mounting surface 321 and the second mounting surface 322 of the lens 30 may be of a random shape, such as a symmetric shape or an asymmetric shape, including a circular ring shape, a square ring shape or a polygon shape and the like. Correspondingly, the lens supporting surface 111 and the lens positioning surface 112 are matched with the first mounting surface 321 and the second mounting surface 322 in shape, may also be of a symmetric shape or an asymmetric shape, including a circular ring shape, a square ring shape or a polygon shape and the like. The substrate 41 of the light source module 40 may be of a random shape, such as a symmetric or asymmetric shape, including a circular shape, a square shape or a polygon shape and the like. Correspondingly, the light source supporting surface 121, the light source positioning surface 122 and the light incident port 21 are matched in shape, the light incident port 21 and the light-emitting unit on the substrate 41 are correspondingly disposed, and the light source supporting surface 121 and the light source positioning surface 122 may be of a random shape, such as a symmetric or asymmetric shape, including a circular shape, a square shape or a polygon shape and the like. Specifically, in the examples of the present disclosure, the lens supporting surface 111 and the lens positioning surface 112 may be both of a circular ring shape, and correspondingly, the first mounting surface 321 and the second mounting surface 322 of the lens 30 also should be of a circular ring shape. The light source supporting surface 121 and the light source positioning surface 122 may be of a circular ring shape or a square ring shape, and correspondingly, the substrate 41 of the light source module 40 may be of a circular or square shape.

It should be noted that the ring shape includes a closed ring shape or an open ring shape. The open ring shape means a ring shape which may be formed by connection and surrounding of a plurality of sections separated from each other.

When the lens supporting surface 111, the lens positioning surface 112, the light source supporting surface 121 and the light source positioning surface 122 may be all of a circular ring shape, they are disposed coaxially with the light incident port 21. The light incident port 21 and the light emergent port 22 may be coaxially disposed.

Figure 5:
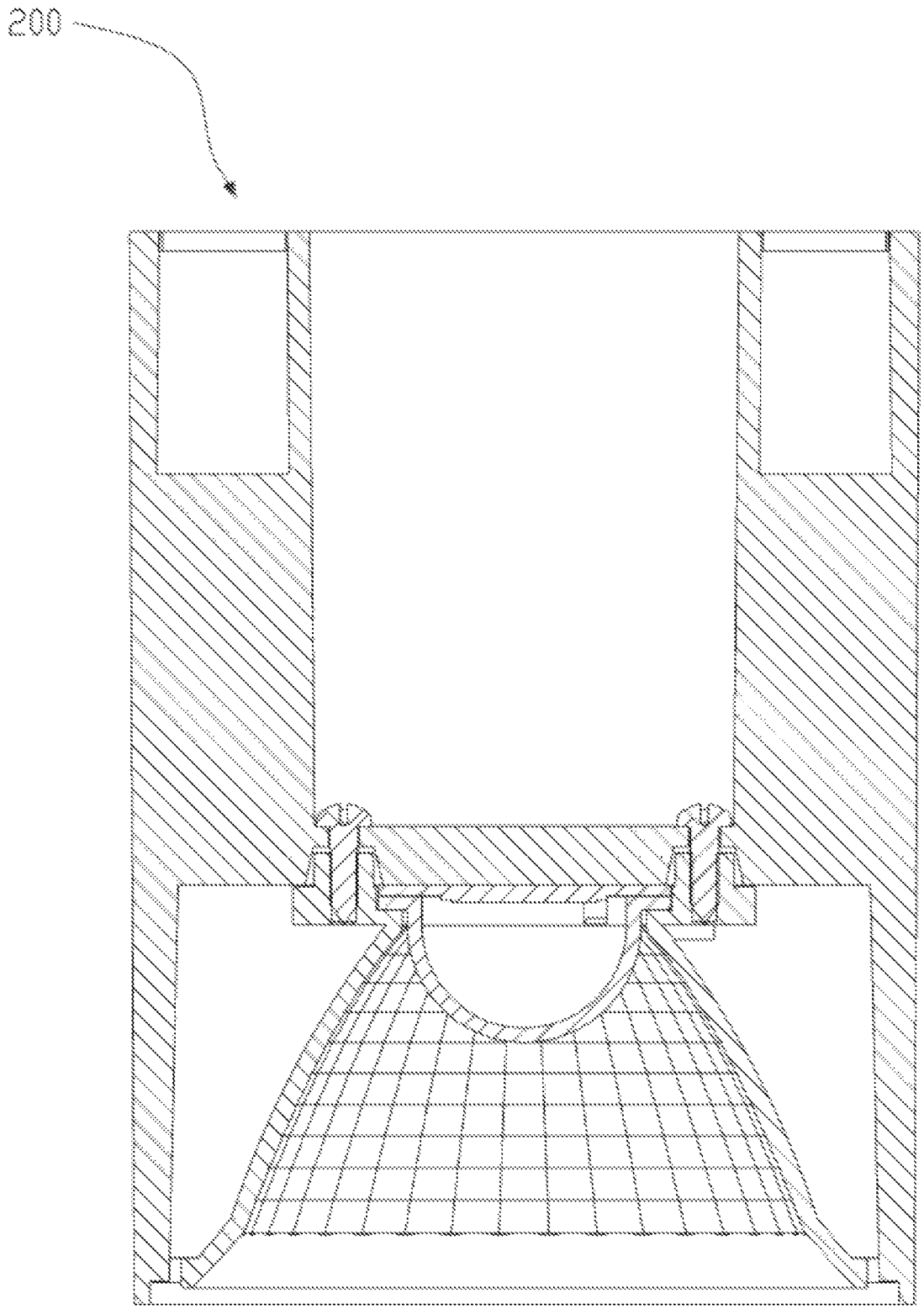
FIG. 5 is a B-B cross-sectional diagram of the lighting apparatus in FIG. 3.
Figure 6:
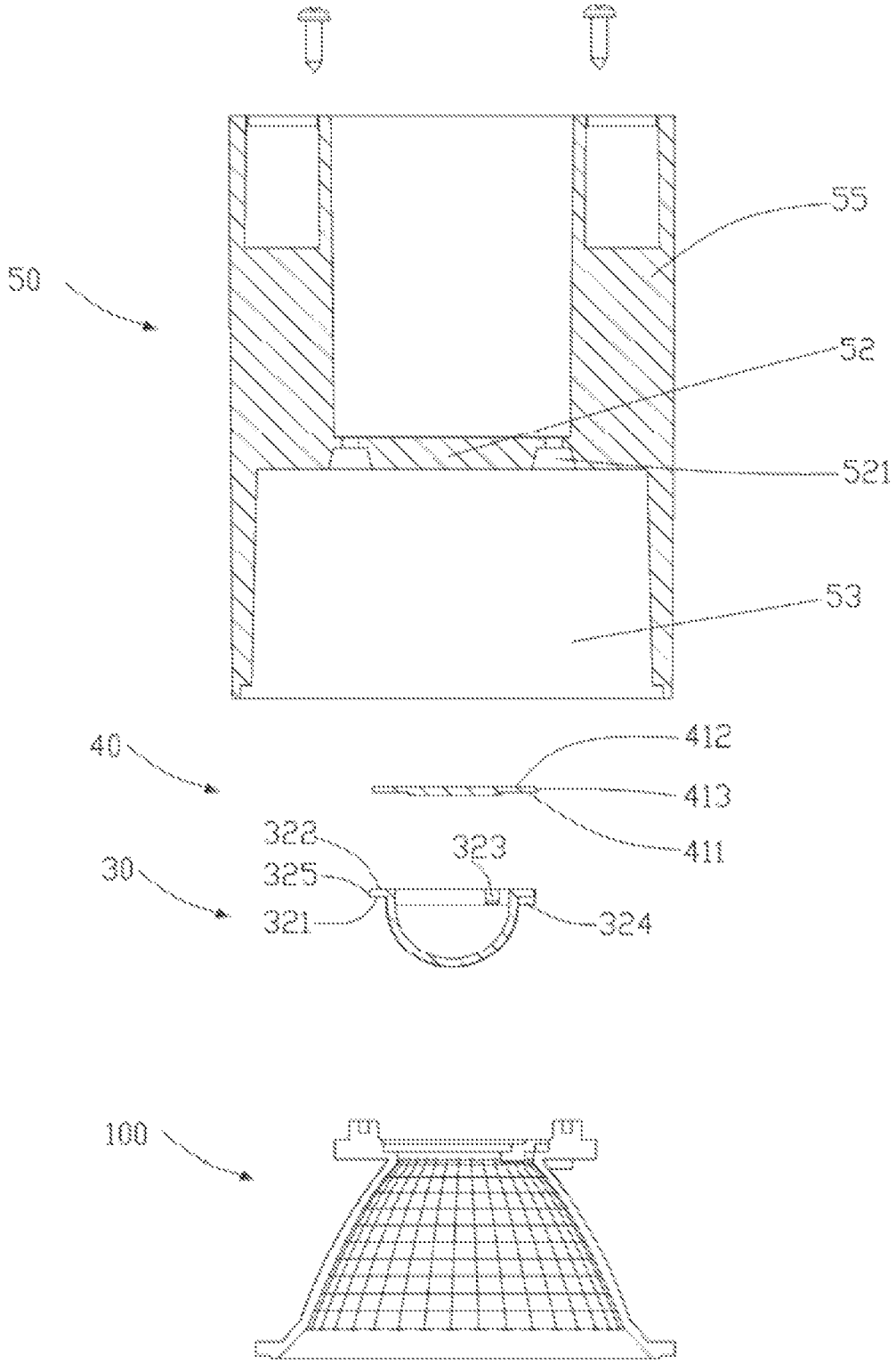
FIG. 6 is an exploded view of the section-view diagram in FIG. 5.

FIG. 5 is a B-B cross-sectional diagram of the lighting apparatus in FIG. 3. FIG. 6 is an exploded view of the section-view diagram in FIG. 5. The lighting apparatus 200 further includes a housing 50. As illustrated in FIG. 4 and FIG. 5, the housing 50 includes a housing light emergent port 521, a bottom wall 52 opposite to the housing light emergent port 521 and an accommodating chamber 53 positioned between the housing light emergent port 521 and the bottom wall 52. The accommodating chamber 53 is used for accommodating the light source module 40, the lens 30 and the reflector 100. After the reflector 100 with the light source module 40 and the lens 30 is moved into the accommodating chamber 53 from the housing light emergent port 521, the second base surface 412 is abutted to and aligned with the first surface 13 on the radial plane, and thus, the bottom wall 52 may be simultaneously attached to the second base surface 412 and the first surface 13, so that the substrate 41 may be clamped between the bottom wall 52 and the mounting portion 32. Moreover, the light emergent port 22 of the reflector 100 and the housing light emergent port 521 are leveled on the radial plane, or with respect to the housing light emergent port 521, the light emergent port 22 of the reflector 100 is close to the bottom wall 52.

The bottom wall 52 is provided with a second threaded hole 521 corresponding to the first threaded hole 17. Specifically, a stud (not labelled) surrounding the first threaded hole 17 protrudes out of the first surface 13. The second threaded hole 521 is a counterbore hole, a head portion of the counterbore hole, which has a large diameter, faces the accommodating chamber 53, and a tail portion of the counterbore hole, which has a small diameter, faces a heat dissipating portion. The head portion of the counterbore hole may accommodate the stud surrounding the first threaded hole 17, and after the reflector 100 is arranged in the accommodating chamber 53 of the housing 50, primary matching between the head portion of the counterbore hole and the stud is implemented by a concave-convex structure. The lighting apparatus 200 further includes a fastener 60. The fastener 60 sequentially passes through the second threaded hole 521 on the bottom wall 52 and the first threaded hole 17 of the mounting table 10 to implement fastened connection of the housing 50 and the mounting table 10; and meanwhile, the bottom wall 52 is attached to the second base surface 412, so that the mounting portion 32 and the substrate 41 are clamped between the light incident port 21 and the bottom wall 52, thereby implementing rapid assembling.

The housing 50 includes a sidewall 54 surrounding the light emergent port 22 and the bottom wall 52 along the axial direction, the sidewall 54 has an inner surface surrounding the accommodating chamber 53, and a fool-proofing structure 541 is disposed on the inner surface. The reflector 100 has a reflecting surface 23 and an outer surface which surround along the axial direction and are opposite to each other, with respect to the reflecting surface 23, the outer surface is close to the inner surface, and a fool-proofing portion 24 is disposed on the outer surface. The fool-proofing structure 541 is in matched connection with the fool-proofing portion 24 so as to implement positioning of the housing 50 and the reflector 100 in the circumferential direction.

The housing 50 further includes a heat dissipating portion 55, and the heat dissipating portion 55 extends from the bottom wall 52 towards a direction facing away from the housing light emergent port 521. Specifically, the heat dissipating portion 55 is of a hollow column shape, i.e., the heat dissipating portion 55 is connected with a peripheral portion of the bottom wall 52 so as to increase an outer surface area of a heat sink, and meanwhile, a central portion of the bottom wall 52 may be in direct contact with the outside, so that the fastener 60 is directly connected with the bottom wall 52 and the mounting table 10 without sequentially passing through the heat dissipating portion 55, the bottom wall 52 and the mounting table 10. Heat of the light source module 40 is conducted to the bottom wall 52 through the second base surface 412 of the substrate 41, and then is conducted to the heat dissipating portion 55 from the bottom wall 52 to be dissipated so as to prolong the service life of the light module.

The second base surface 412 may be coated with a heat conducting medium so as to improve efficiency of conducting heat of the second base surface 412 to the heat dissipating portion 55. The heat conducting medium may be heat conducting silica gel or heat conducting silicone grease.

The heat dissipating portion 55 is provided with a wire hole (not shown) which runs through the accommodating chamber 53 and an outer portion of the housing 50 for the wire of the light source module 40 to penetrate through the housing 50.

The lighting apparatus in the examples of the present disclosure has the specific assembling process as follows: the mounting portion 32 of the lens 30 is mounted to the lens connecting portion 11 of the reflector 100, and the light distributing portion 31 of the lens extends into the reflecting chamber 20 from the light incident port 21 of the reflector 100; the light source module 40 with the wire is mounted on the reflector 100, the first base surface 411 of the light source module 40 is attached to the second mounting surface 322 of the lens 30 and the light source supporting surface 121, and the wire of the light source module 40 is clamped into the second wire groove 323 and the first wire groove 16 and extends out of the reflector 100; the heat conducting silicone grease is coated on the second base surface 412 of the light source module; the wire of the light source module 40 passes through the wire hole on the heat dissipating portion 55, and after the fool-proofing portion 24 and the fool-proofing structure 541 are structurally aligned, the reflector 100 with the light source module 40 and the lens 30 is placed in the accommodating chamber 53, so that the second base surface 412 is attached to the bottom wall 52; and the fastener 60 sequentially passes through the second threaded hole 521 of the bottom wall 52 and the first threaded hole 17 of the mounting table 10 to implement fastened connection of the bottom wall 52 and the mounting table 10.

In order to reduce the process difficulty and the damage probability of a lighting apparatus in the repairing or maintaining process, the present disclosure discloses a reflector and a lighting apparatus.

The present disclosure provides a reflector comprising a mounting table and a reflecting chamber, the reflecting chamber has an axis and a light incident port and a light emergent port which are opposite to each other and sequentially distributed along a direction of the axis, and the mounting table is connected with a periphery of the light incident port and extending outwards along a radial direction of the reflecting chamber; and a lens connecting portion and a light source connecting portion are disposed on the mounting table.

For the reflector mentioned above, the mounting table has a first surface and a second surface which are opposite to each other and extend along a radial plane of the reflecting chamber; with respect to the second surface, the first surface is away from the light emergent port; and the lens connecting portion and the light source connecting portion are disposed on the first surface.

For the reflector mentioned above, the lens connecting portion surrounds the light incident port along a circumferential direction of the reflector; and the light source connecting portion surrounds the lens connecting portion along the circumferential direction.

For the reflector mentioned above, the lens connecting portion has a lens supporting surface which is of a ring shape and extends along the radial plane, and the light source connecting portion has a light source supporting surface which is of a ring shape and extends along the radial plane; and with respect to the lens supporting surface, the light source supporting surface is away from the light emergent port.

For the reflector mentioned above, the lens connecting portion further has a lens positioning surface, and the lens positioning surface extends from the lens supporting surface towards a direction facing away from the second surface; and the light source connecting portion further has a light source positioning surface, and the light source positioning surface extends from the light source supporting surface towards the direction facing away from the second surface.

For the reflector mentioned above, the lens supporting surface is connected with the light incident port; the lens positioning surface is connected with the lens supporting surface and the light source supporting surface; and the light source positioning surface is connected with the light source supporting surface and the first surface.

For the reflector mentioned above, the mounting table has an outer sidewall connecting the first surface and the second surface and away from the light source connecting portion, a first wire groove is disposed on the first surface, and the first wire groove is in through connection with the light incident port and the outer sidewall.

For the reflector mentioned above, the first wire groove has a groove bottom and a groove wall, a chuck is disposed on the groove wall, and a gap is formed between the chuck and the groove bottom.

For the reflector mentioned above, the reflecting chamber has a reflecting surface, and the reflecting surface has a specular reflecting region and a diffuse reflecting region; and with respect to the diffuse reflecting region, the specular reflecting region is close to the light incident port.

The present disclosure provides a lighting apparatus comprising a lens, a light source module and the reflector mentioned above; the lens is positioned between the light incident port and the light source module along the direction of the axis, the lens includes a light distributing portion and a mounting portion connected with the light distributing portion, the light distributing portion covers the light incident port and the mounting portion is connected to the lens connecting portion; and the light source module includes a substrate and a light-emitting unit mounted on the substrate, the substrate is connected to the light source connecting portion, and the light-emitting unit faces the light distributing portion.

For the lighting apparatus mentioned above, the lens connecting portion surrounds the light incident port along a circumferential direction of the reflector; and the light source connecting portion surrounds the lens connecting portion along the circumferential direction; and the mounting portion surrounds the light distributing portion along the axis, the light-emitting unit is mounted at a middle portion of the substrate, and a projection of the substrate on a radial plane completely covers a projection of the mounting portion on the radial plane.

For the lighting apparatus mentioned above, the lens connecting portion has a lens supporting surface which is of a ring shape and extends along the radial plane, and the light source connecting portion has a light source supporting surface which is of a ring shape and extends along the radial plane; with respect to the lens supporting surface, the light source supporting surface is away from the light emergent port;

the mounting portion has a first mounting surface and a second mounting surface which are opposite to each other and extend along the radial plane, and the first mounting surface is attached to the lens supporting surface; and the substrate has a first base surface and a second base surface which are opposite to each other and extend along the radial plane, the light-emitting unit is mounted at a middle portion on the first base surface, and a periphery of the first base surface is attached to the light source supporting surface along the circumferential direction.

For the lighting apparatus mentioned above, the mounting table has a first surface and a second surface which are opposite to each other and extend along the radial plane of the reflecting chamber; with respect to the second surface, the first surface is away from the light emergent port; the lens connecting portion and the light source connecting portion are disposed on the first surface;

the lens connecting portion further has a lens positioning surface, and the lens positioning surface extends from the lens supporting surface towards a direction facing away from the second surface; and the light source connecting portion further has a light source positioning surface, and the light source positioning surface extends from the light source supporting surface towards the direction facing away from the second surface;

the mounting portion further includes a first outer ring surface connecting the first mounting surface and the second mounting surface and away from the light distributing portion, and when the first mounting surface is attached to the lens supporting surface, the lens positioning surface surrounds the first outer ring surface along the circumferential direction; and the substrate further includes a second outer ring surface connecting with the first base surface and the second base surface and away from the light-emitting unit, and when the first base surface is attached to the light source supporting surface, the light source positioning surface surrounds the second outer ring surface along the circumferential direction.

For the lighting apparatus mentioned above, the second mounting surface is abutted to and levelled with the light source supporting surface on the radial plane, and the first base surface is simultaneously attached to the light source supporting surface and the second mounting surface.

For the lighting apparatus mentioned above, the mounting table has an outer sidewall connecting the first surface and the second surface and away from the light incident port, a first wire groove is disposed on the first surface, and the first wire groove is in through connection with the light incident port and the outer sidewall of the reflector; and a second wire groove in through connection with the light distributing portion and the first outer ring surface is disposed on the second mounting surface, and the second wire groove is in through connection with the first wire groove.

The lighting apparatus mentioned above further comprises a housing, the housing including a housing light emergent port, a bottom wall opposite to the housing light emergent port, and an accommodating chamber positioned between the housing light emergent port and the bottom wall; the accommodating chamber accommodating the light source module, the lens and the reflector; and the second base surface is abutted to and levelled with the first surface on the radial plane, and the bottom wall being simultaneously attached to the second base surface and the first surface.

The lighting apparatus mentioned above further comprises a fastener, the fastener connecting the bottom wall and the mounting table from the bottom wall towards a direction facing the mounting table.

For the lighting apparatus mentioned above, the housing further includes a sidewall surrounding the light emergent port and the bottom wall along the axis; the sidewall has an inner surface surrounding to form the accommodating chamber, and a fool-proofing structure is disposed on the inner surface; the reflector has a reflecting surface and an outer surface surrounding and oppositely disposed along the axis, with respect to the reflecting surface, the outer surface is close to the inner surface, and a fool-proofing portion is disposed on the outer surface; and the fool-proofing structure is in matched connection with the fool-proofing portion.

For the lighting apparatus mentioned above, the housing further includes a heat dissipating portion extending from the bottom wall towards a direction facing away from the housing light emergent port.

For the lighting apparatus mentioned above, the light distributing portion has a protrusion, and the protrusion extends into the reflecting chamber from the light incident port.

For the lighting apparatus mentioned above, the light source module is a Chip on Board (COB) light source.

According to the reflector and the lighting apparatus which are provided by the present disclosure, the reflector is provided with a mounting table and a reflecting chamber, the mounting table is connected with a periphery of a light incident port of the reflecting chamber and extends outwards along a radial direction of the reflecting chamber, and the mounting table is provided with a lens connecting portion and a light source connecting portion for implementing positioning or connection of a light source module and a lens, so that in the assembling process, the light source module and the lens can be mounted on a housing together with the reflector without being mounted in an accommodating chamber of the housing one by one; moreover, the mounting table is not positioned inside the reflecting chamber, and thus, the light source module and the lens can be mounted outside the reflecting chamber so as to facilitate assembling. A reflector assembly with the lens and the light source module may be accommodated in the accommodating chamber of the housing, and the lens, the light source module and the reflector can be all transferred into the accommodating chamber only by one-time transfer so as to reduce the process difficulty and the damage probability of the lighting apparatus in the repairing or maintaining process.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The foregoing specific examples further illustrate the objects, technical solutions and beneficial effects of the present disclosure in detail, and it should be understood that the foregoing examples merely are specific examples of the disclosure, and not intended to limit the disclosure, and any modifications, equivalent replacements, improvements and the like within the spirit and principle of the disclosure shall fall within the scope of protection of the disclosure.

The invention claimed is:

1. A reflector, comprising a mounting table and a reflecting chamber, wherein the reflecting chamber has an axis and a light incident port and a light emergent port which are opposite to each other and sequentially distributed along a direction of the axis, and the mounting table is connected with a periphery of the light incident port and extends outwards along a radial direction of the reflecting chamber; and a lens connecting portion and a light source connecting portion are disposed on the mounting table.

2. The reflector according to claim 1, wherein the mounting table has a first surface and a second surface which are opposite to each other and extend along a radial plane of the reflecting chamber; the first surface is away from the light emergent port; and the lens connecting portion and the light source connecting portion are disposed on the first surface.

3. The reflector according to claim 2, wherein the lens connecting portion surrounds the light incident port along a circumferential direction of the reflector; and the light source connecting portion surrounds the lens connecting portion along the circumferential direction.

4. The reflector according to claim 3, wherein the lens connecting portion has a lens supporting surface which is of a ring shape and extends along the radial plane, and the light source connecting portion has a light source supporting surface which is of a ring shape and extends along the radial plane; and the light source supporting surface is away from the light emergent port.

5. The reflector according to claim 4, wherein the lens connecting portion further has a lens positioning surface, and the lens positioning surface extends from the lens supporting surface towards a direction facing away from the second surface; and the light source connecting portion further has a light source positioning surface, and the light source positioning surface extends from the light source supporting surface towards the direction facing away from the second surface.

6. The reflector according to claim 5, wherein the lens supporting surface is connected with the light incident port; the lens positioning surface is connected with the lens supporting surface and the light source supporting surface; and the light source positioning surface is connected with the light source supporting surface and the first surface.

7. The reflector according to claim 2, wherein the mounting table has an outer sidewall that connects the first surface and the second surface and is away from the light source connecting portion, a first wire groove is disposed on the first surface, and the first wire groove is in through connection with the light incident port and the outer sidewall.

8. The reflector according to claim 7, wherein the first wire groove has a groove bottom and a groove wall, a chuck is disposed on the groove wall, and a gap is formed between the chuck and the groove bottom.

9. The reflector according to claim 1, wherein the reflecting chamber has a reflecting surface, and the reflecting surface has a specular reflecting region and a diffuse reflecting region; and the specular reflecting region is close to the light incident port.

10. A lighting apparatus, comprising a lens, a light source module and the reflector, wherein:

the reflector comprises a mounting table and a reflecting chamber, the reflecting chamber has an axis and a light incident port and a light emergent port which are opposite to each other and sequentially distributed along a direction of the axis, and the mounting table is connected with a periphery of the light incident port and extends outwards along a radial direction of the reflecting chamber; and a lens connecting portion and a light source connecting portion are disposed on the mounting table;

the lens is positioned between the light incident port and the light source module along the direction of the axis, the lens comprises a light distributing portion and a mounting portion connected with the light distributing portion, the light distributing portion covers the light incident port and the mounting portion is connected to the lens connecting portion; and the light source module comprises a substrate and a light-emitting unit mounted on the substrate, the substrate is connected to the light source connecting portion, and the light-emitting unit faces the light distributing portion.

11. The lighting apparatus according to claim 10, wherein:

the lens connecting portion surrounds the light incident port along a circumferential direction of the reflector; and the light source connecting portion surrounds the lens connecting portion along the circumferential direction; and the mounting portion surrounds the light distributing portion along the axis, the light-emitting unit is mounted at a middle portion of the substrate, and a projection of the substrate on a radial plane completely covers a projection of the mounting portion on the radial plane.

12. The lighting apparatus according to claim 11, wherein:

the lens connecting portion has a lens supporting surface which is of a ring shape and extends along the radial plane, and the light source connecting portion has a light source supporting surface which is of a ring shape and extends along the radial plane; the light source supporting surface is away from the light emergent port;

the mounting portion has a first mounting surface and a second mounting surface which are opposite to each other and extend along the radial plane, and the first mounting surface is attached to the lens supporting surface; and the substrate has a first base surface and a second base surface which are opposite to each other and extend along the radial plane, the light-emitting unit is mounted at a middle portion on the first base surface, and a periphery of the first base surface is attached to the light source supporting surface along the circumferential direction.

13. The lighting apparatus according to claim 12, wherein:

the mounting table has a first surface and a second surface which are opposite to each other and extend along the radial plane of the reflecting chamber; the first surface is away from the light emergent port; the lens connecting portion and the light source connecting portion are disposed on the first surface;

the lens connecting portion further has a lens positioning surface, and the lens positioning surface extends from the lens supporting surface towards a direction facing away from the second surface; and the light source connecting portion further has a light source positioning surface, and the light source positioning surface extends from the light source supporting surface towards the direction facing away from the second surface;

the mounting portion further comprises a first outer ring surface that connects the first mounting surface and the second mounting surface and is away from the light distributing portion, and when the first mounting surface is attached to the lens supporting surface, the lens positioning surface surrounds the first outer ring surface along the circumferential direction; and the substrate further comprises a second outer ring surface that connects with the first base surface and the second base surface and is away from the light-emitting unit, and when the first base surface is attached to the light source supporting surface, the light source positioning surface surrounds the second outer ring surface along the circumferential direction.

14. The lighting apparatus according to claim 13, wherein the second mounting surface is abutted to and levelled with the light source supporting surface on the radial plane, and the first base surface is simultaneously attached to the light source supporting surface and the second mounting surface.

15. The lighting apparatus according to claim 14, wherein:

the mounting table has an outer sidewall that connects the first surface and the second surface and is away from the light incident port, a first wire groove is disposed on the first surface, and the first wire groove is in through connection with the light incident port and the outer sidewall of the reflector; and a second wire groove is in through connection with the light distributing portion and the first outer ring surface is disposed on the second mounting surface, and the second wire groove is in through connection with the first wire groove.

16. The lighting apparatus according to claim 12, further comprising a housing, wherein:

the housing comprises a housing light emergent port, a bottom wall opposite to the housing light emergent port, and an accommodating chamber positioned between the housing light emergent port and the bottom wall; the accommodating chamber accommodates the light source module, the lens and the reflector; and the second base surface is abutted to and levelled with the first surface on the radial plane, and the bottom wall is simultaneously attached to the second base surface and the first surface.

17. The lighting apparatus according to claim 16, comprising a fastener, wherein the fastener connects the bottom wall and the mounting table from the bottom wall towards a direction facing the mounting table.

18. The lighting apparatus according to claim 16, wherein the housing further comprises a sidewall surrounding the light emergent port and the bottom wall along the axis; the sidewall has an inner surface surrounding to form the accommodating chamber, and a fool-proofing structure is disposed on the inner surface; the reflector has a reflecting surface and an outer surface that surround and oppositely are disposed along the axis, the outer surface is close to the inner surface, and a fool-proofing portion is disposed on the outer surface; and the fool-proofing structure is in matched connection with the fool-proofing portion.

19. The lighting apparatus according to claim 16, wherein the housing further comprises a heat dissipating portion extending from the bottom wall towards a direction facing away from the housing light emergent port.

20. The lighting apparatus according to claim 10, wherein the light distributing portion comprises a protrusion, and the protrusion extends into the reflecting chamber from the light incident port.

* * * * *